US005699907A

United States Patent [19]

Langenstück

[11] Patent Number: 5,699,907

[45] Date of Patent: Dec. 23, 1997

[54] PACK FOR KNIVES AND THE LIKE

[75] Inventor: Holger Langenstück, Ober-Mörlen, Germany

[73] Assignee: Beiersdorf Aktiengesellschaft, Hamburg, Germany

[21] Appl. No.: 796,315

[22] Filed: Feb. 7, 1997

Related U.S. Application Data

[63] Continuation of Ser. No. 524,814, Sep. 7, 1995, abandoned.

[30] Foreign Application Priority Data

Sep. 12, 1994 [DE] Germany ..... 44 32 355.7

[51] Int. Cl.[6] ..... B65D 73/00; B65D 75/64

[52] U.S. Cl. ..... 206/349; 206/460; 206/813

[58] Field of Search ..... 206/349, 460, 206/461, 813

[56] References Cited

U.S. PATENT DOCUMENTS

| | | | |
|---|---|---|---|
| 3,227,268 | 1/1966 | Gringer | 206/460 |
| 3,334,736 | 8/1967 | Cole et al. | 206/460 |
| 4,053,049 | 10/1977 | Beauvais | 206/460 |
| 4,111,297 | 9/1978 | Paulin | 206/806 |
| 4,132,309 | 1/1979 | Shaylor | 206/460 |
| 4,177,898 | 12/1979 | Humphrey | 206/45.33 |
| 4,771,891 | 9/1988 | Sorensen et al. | 206/459.5 |
| 4,867,310 | 9/1989 | Cannon et al. | 206/460 |
| 4,966,281 | 10/1990 | Kawanishi et al. | 206/460 |
| 5,158,818 | 10/1992 | Aurichio | 206/460 |
| 5,311,992 | 5/1994 | Weder et al. | 206/813 |
| 5,410,856 | 5/1995 | Weder et al. | 206/423 |

FOREIGN PATENT DOCUMENTS

| | | | |
|---|---|---|---|
| 684925 | 4/1964 | Canada | 206/813 |

*Primary Examiner*—Jimmy G. Foster

*Attorney, Agent, or Firm*—Sprung Kramer Schaefer & Briscoe

[57] ABSTRACT

Pack for knives and the like, which protectively encloses the blade while leaving the handle free to be taken hold of, characterized by two films (1) which have been given a one-sided self-adhesive finish and which can be stuck on both sides onto the blade (2) while overlapping it, the overlapping regions (3, 4) of the films (1) sticking to one another by means of their self-adhesive-finished sides, and the ends of the films (1) possessing a nonadhesive grip element (5) so that the pack can be pulled open, and the adhesive on the self-adhesive-finished films (1) permitting residue-free removal from the blade (2).

6 Claims, 1 Drawing Sheet

PACK FOR KNIVES AND THE LIKE

Figure 1:
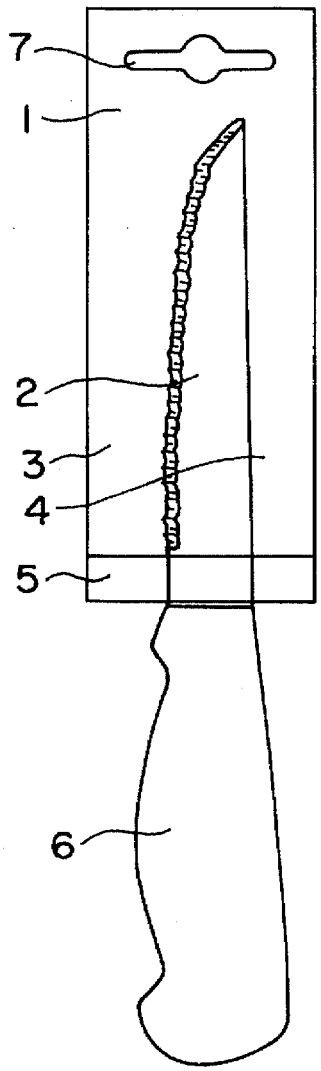

This application is a continuation of application Ser. No. 08/524,814, filed on Sep. 7, 1995 which is now abandoned.

DESCRIPTION

The invention relates to a pack for knives and the like which protectively encloses the blade while leaving the handle free to be taken hold of.

Packs of this kind are known. For instance, knives and the like are offered for sale, for protection against injury, in elongate sleeves which cover the blade and are fastened on the handle with a button-down tab. In this arrangement, at least one side of the sleeve is transparent, so that the knife along with its blade can be seen, while the handle remains free in order to enable tentative handling. Variants of such packs are also known, all of which, however, are extremely complex and can be applied only with considerable intensity of labour. Moreover, the material to be disposed of is coming under increasing criticism.

The object of the invention was to remedy this situation and to provide, in particular, a pack for hives and the like which does not have the disadvantages of the prior art, or not to the same extent, and which, in particular, offers good protection using little of a material which, at the same time, can be disposed of without problems.

Accordingly, the invention relates to a pack as defined more closely in the claims.

Such packs are particularly suitable for knives of all kinds, which depending on the length of their blades are packaged with suitable sizes of films. However, this pack is also suitable for other implements, for example for scissors or tools, for which a prospective purchaser is to be given the possibility of holding the respective handle without hindrance and of picking up the implement without being burdened by a heavy and bulky pack hut nevertheless being protected against any possible injury.

The films employed are preferably PP films in thicknesses from about 40 μm to 160 μm, in which case a coloured, printable PP film is particularly suitable for the rear film while the front film is, in particular, a printable, transparent PP film. In this arrangement the coloration prevents the two sections of printing from showing through and enables correct reading of the items of information applied.

The films are provided with an adhesive which enables them to be pulled off from the blade or the like without residue while still ensuring a good hold. Such adhesives are known, for instance, from DE 2 523 617 A1, DE 3 208 217 A1, EP 213 860 A1, U.S. Pat. No. 4,599,265 and EP 121 430 A1, and DE 3 346 100 A1 for adhesives to be applied in screen printing, etc. This arrangement not only provides for residue-free removal, from the blade of a knife for instance, but also removal of the areas of film which are stuck to one another, without having to exert inappropriately large forces.

The grip element provided is preferably free of adhesive, but can also be realized by an appropriate cover or by a pressed-on element, as is general state of the art.

The intention below is to illustrate the invention in more detail with reference to examples, but without thereby unnecessarily restricting this invention.

Figure 2:
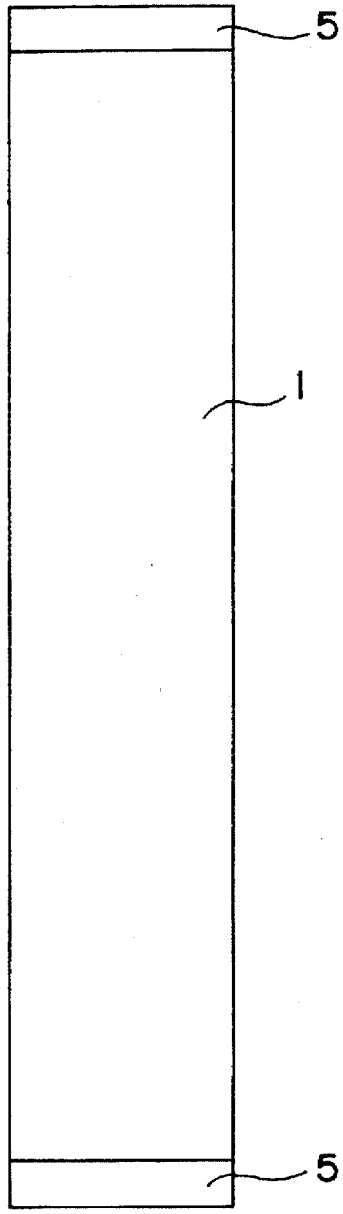

In the figures,

FIG. 1 shows a plan view of a knife packed in accordance with the invention, and FIG. 2 shows a plan view of a pack prior to its use.

Specifically, FIG. 1 shows an 80 μm thick PP film provided with an adhesive according to Example 1 of DE 3 346 100 A1, while a film of the same kind, but coloured white, sticks down from behind the blade 2 of the knife shown. In regions 3 and 4, these films stick against one another by means of their adhesive compositions. Grip elements 5 are provided so that the films 1 can be easily grasped, for instance while the other hand holds the handle 6 of the knife, in which case the films 1 can be pulled off without residue and with minimal exertion of force from the blade 2.

In the upper region of the films 1, which covers the tip of the blade 2, a Euro-hole 7 is provided. The packaged knife can thus be hung in a display unit or the like which is intended for it.

FIG. 2 shows a variant in which the films 1 constitute a single piece, again with grip elements 5. This film 1 can be folded over on itself and placed around a blade in such a way that the enclosed blade, of a knife or the like, is protected securely and without problems. A hole for suspension, corresponding for instance to the Euro-hole 7 of FIG. 1, can then advantageously be punched into the finished pack arrangement.

Suitable dimensions of films 1, for example, are 235 times 70 mm for a bread knife or meat knife, 180 times 70 mm for a steak knife, all-purpose knife or work knife, and 110 times 55 mm for a vegetable knife.

It is also advantageous to provide the films used with a metal strip in order to obtain the properties of an alarm label. In this case, the separate application of an alarm label is unnecessary.

I claim:

1. A pack for a knife, which knife comprises a blade and a handle, said pack comprising two layers of polypropylene film, each having a thickness of from about 40 μm to 160 μm, and which enclose the blade of the knife, but not the handle, between them, and each of which has a self-adhesive finish on the side facing the other layer, which adheres the layers to each other, as well as to the knife blade, but which remains on the film and not on the blade when the two layers of film are separated from each other and from the knife blade, said films further comprising opposing nonadhesive grip elements at one end of the film.

2. The pack according to claim 1 wherein one of the films is colored.

3. The pack according to claim 1, wherein the films are formed from one piece of film which was turned over on itself and placed on both sides of the blade.

4. The pack according to claim 1, which possess a punched-out hole for the purposes of hanging the pack.

5. The pack according to claim 1, wherein the adhesive is applied by screen printing or intaglio printing.

6. The pack of claim 1, wherein one of the films is transparent.

* * * * *